United States Patent [19]

Fujita et al.

[11] Patent Number: 5,007,956

[45] Date of Patent: Apr. 16, 1991

[54] ASSEMBLED CAM SHAFT

[75] Inventors: Yoshiaki Fujita, Saitama; Satoshi Kawai; Shunsuke Takeguchi, both of Tochighi, all of Japan

[73] Assignee: Nippon Piston Ring Co., Ltd., Tokyo, Japan

[21] Appl. No.: 263,967

[22] Filed: Oct. 27, 1988

Related U.S. Application Data

[63] Continuation of Ser. No. 35,780, Apr. 8, 1987, abandoned.

[30] Foreign Application Priority Data

Apr. 11, 1986 [JP] Japan ..... 61-83580

[51] Int. Cl.[5] ..... C22C 29/04

[52] U.S. Cl. ..... 75/238; 75/241; 75/243; 75/244; 75/246

[58] Field of Search ..... 75/241, 238, 244, 243, 75/232, 246; 228/135; 428/539.5

[56] References Cited

U.S. PATENT DOCUMENTS

| | | | |
|---|---|---|---|
| 1,252,596 | 1/1918 | McMillin . | |
| 1,702,128 | 2/1929 | Niedringhaus et al. . | |
| 2,192,645 | 3/1940 | Lauenstein et al. . | |
| 3,698,964 | 10/1972 | Caule et al. . | |
| 3,713,817 | 1/1973 | Reen . | |
| 4,204,031 | 5/1980 | Takemura et al. | 428/539.5 |
| 4,233,073 | 11/1980 | Takemura | 75/243 |
| 4,253,874 | 3/1981 | Cundill . | |
| 4,265,388 | 5/1981 | Takahashi et al. | 228/135 |
| 4,274,875 | 6/1981 | Cadle et al. | 75/232 |
| 4,311,524 | 1/1982 | Genkin et al. | 75/231 |
| 4,348,232 | 9/1982 | Hiraoka et al. | 75/237 |
| 4,702,771 | 10/1987 | Takagi et al. | 75/241 |

FOREIGN PATENT DOCUMENTS

| | | |
|---|---|---|
| 0202035 | 11/1986 | European Pat. Off. . |
| 58-22358 | 2/1983 | Japan . |
| 58-22359 | 2/1983 | Japan . |
| 979414 | 1/1965 | United Kingdom . |
| 1580686 | 12/1980 | United Kingdom . |
| 1580687 | 12/1980 | United Kingdom . |
| 1580688 | 12/1980 | United Kingdom . |
| 2155037 | 9/1985 | United Kingdom . |
| 2176803 | 1/1987 | United Kingdom . |

OTHER PUBLICATIONS

Hendersen et al, *Metallurgical Dictionary*, 1953, pp. 287–288.

*Primary Examiner*—Stephen J. Lechert, Jr.
*Assistant Examiner*—Nina Bhat
*Attorney, Agent, or Firm*—Birch, Stewart, Kolasch & Birch

[57] ABSTRACT

An assembled cam shaft including a steel cam shaft member, a journal member made of sintered material and a cam lobe. The sintered material consisting essentially of 0.5 to 4.0% by weight of carbon, 0.1 to 0.8% by weight of phosphorus, 5 to 50% by weight of copper, 1% by weight or less of manganese, 2% by weight or less of silicon, and the balance being iron and impurities.

4 Claims, 1 Drawing Sheet

ASSEMBLED CAM SHAFT

This application is a continuation of application Ser. No. 07/035,780, filed on Apr. 8, 1987, now abandoned.

BACKGROUND OF THE INVENTION

The present invention relates to an assembled cam shaft for an internal combustion engine, and more particularly to an assembled cam shaft in which a cam lobe and a journal are made of sintered alloys and conjoined to a steel shaft member.

As for a conventional assembled cam shaft in which a cam lobe, a journal member and so forth are separately manufactured and conjoined to a steel shaft member, most of the cam shaft elements such as the journal and gears except the cam lobe are made of steel. Although it is relatively easy to perform finishing work on the steel, various production steps may be required for joining the journal etc. to the steel shaft member due to machining of such mechanical parts and brazing or the like. For that reason, the manufacture of the cam shaft is rather costly. Further, wear resistance of a sliding portion made of steel is low, especially when the portion is used as the journal.

Copending U.S. patent applications have been filed bearing Ser. Nos. 722,223 and 722,224. Further, sintered alloys for use internal comubstion engines are described for example in U.S. Pat. Nos. 4,388,114, 4,491,477, 4,345,943, 4,363,662, 4,505,988 and 4,334,926.

SUMMARY OF THE INVENTION

The present invention was made in order to solve the above-described problems. Accordingly, it is an object of the present invention to provide an improved assembled cam shaft which has a high wear resistance and a good machining property, and is less damaging to an opposing member in sliding contact with the cam shaft and easy to manufacture.

Each assembled portion of the assembled cam shaft except the cam lobe and the shaft member is made of a sintered material, and essentially consists of 0.5 to 4.0 % by weight of carbon, 0.1 to 0.8 % by weight of phosphorus, 5.0 to 50% by weight of copper, 1% by weight or less of manganese, 2% by weight or less of silicon, and the remainder iron and impurities. Alternatively, the cam shaft, except for the cam lobe consists essentially of 0.5 to 4.0% by weight of carbon, 0.1 to 0.8% by weight of phosphorus, 5 to 50% by weight of copper, 1% by weight or less of manganese, 2% by weight or less of silicon, at least one of a composition selected from a group consisting of 0.5 to 3.0% by weight of nickel, 0.1 to 2.0 by weight of molybdenum, 0.1 to 2.0% by weight of chromium and 0.01 to 1.0% by weight of boron, and the remainder iron and impurities.

The reasons why the percentages of the constituents of the sintered material are limited as described above will be explained.

A part of the 0.5 to 4.0% by weight of carbon is solid-solved in the matrix of the sintered material to strengthen the matrix, while the other part thereof forms a carbide. If the amount of the carbon is less than 0.5% by weight, the above-described effect are not obtainable, so that the wear resistance and self-lubricating property of the sintered material are degraded. If the amount of carbon is more than 4.0% by weight, coarse carbide crystal grains may be generated and the carbon interacts with phosphorus to generate an excess liquid phase to thus make it impossible to maintain the configuration of each assembled portion of the cam shaft.

Phosphorus acts to form an iron-carbon-phosphorus-eutectic steadite to enhance wear resistance of the sintered material. If the phosphorus amount is less than 0.1% by weight, the above described effect is not obtainable. If the amount of phosphorus is more than 0.8 % by weight the amount of the educed steadite becomes excessive causing deterioration of the machinability of the sintered material causing deterioration of the the embrittlement thereof.

A part of the 5 to 50% by weight of copper is solid-solved in the matrix of the sintered material to strengthen the pearlitic matrix thereof, while the other part acts to improve the brazing of each assembled portion to the steel shaft member and is dispersed in the sintered material to enhance machinability and wear resistance. If the amount of copper is less than 5% by weight, the amount of the free copper is too small to improve the brazing, and it is impossible to enhance the machinability and of copper is more than 50% by weight, the amount of copper is excessive which lower the apparent hardness of the sintered material and thus degrades the wear resistance. Furthermore, the cost of material is increased to causing an economical disadvantage. The more preferable amount of copper is 15 to 40% by weight.

If the amount of manganese is more than 1.0% by weight, sinterability of the material is restrained to form large voids therein and compactibility of the powdered material to be sintered is lowered.

If the amount of silicon is more than 2% by weight, the matrix of the sintered material is embrittled and compactibility of the powdered material is lowered, to thereby increase the deformation of the material at the time of sintering.

Nickel, molybdenum, chromium and boron each forms carbide which enhances wear resistance of the sintered material and strengthens the matrix thereof. If the amount of nickel, molybdenum, chromium and boron are less than 0.5 wt%, 0.1 wt%, 0.1 wt% and 0.01 wt%, respectively, the above-described effects are not obtainable. If the amounts of nickel, molybdenum, chromium and boron are more than 3.0 wt%, 2.0 wt%, 2.0 wt% and 1.0 wt%, respectively, hardness of the sintered material is disadvantageously increased to degrade machinability.

When the amount of carbon is 1% by weight or more and that of the phosphorus is 0.4% by weight or more, the amount of liquid phase of the sintered material is increased so that shrinkage of the assembled portion made of the sintered material becomes 1 to 15 % to the outside diameter of the steel shaft member. Therefore, the free copper are discharged to the surface of the portion conjoined to the steel shaft member due to capillary action and at the same time, the clearance between the assembled portion and the steel shaft is reduced to stabilize the brazing of the assembled portion to the steel shaft member. Also, the porosity of the sintered material is reduced to provide a preferable apparent hardness of HRB ranging from 80 to 110.

If high dimensional accuracy of the assembled portion is to be required, the portion should be made of the solid-phase sintered material whose carbon ratio, phosphorus ratio and shrinkage are less than 1.0 wt%, less than 0.4 wt% and 1% or less, respectively.

When the assembled cam shaft is to be manufactured, the powdered material to be sintered is compacted and assembled on the steel shaft member, and then sintered at a temperature of 1050° to 1200° C. so as to be fixedly conjoined to the steel shaft member In order to lower the manufacturing cost of the assembled cam shaft, it is necessary to conjoin all the assembled portions together under the same conditions. For that reason, it is preferable that the cam lobe which is one of the assembled portions of the cam shaft is made of a sintered material such as a wear-resistant sintered alloy disclosed in copending U.S. patent application Ser. No. 722,223. The sintered material disclosed therein comprises 1.5 to 4.0 wt% of carbon, 0.5 to 1.2 wt% of silicon, 1 wt.% or less of manganese, 0.2 to 0.8 wt% of phosphorus, 2 to 20 wt% of chromium, 0.5 to 2.5 wt% of molybdenum, 0.5 to 2.5 wt% of nickel and remainder iron and impurities. The sintered material may further contain 0.01 to 5.0 wt% of at least one of tin, bismuth, antimony and cobalt to the former wear-resistant sintered alloy.

DETAILED DESCRIPTION OF THE PREFERRED EMBODIMENTS

Results of quality confirmation tests on embodiments of the present invention and on comparative samples therefor are hereinafter described in detail.

As shown in Table 1, prepared are test pieces which are journals as assembled portions made of sintered alloys and having compositions Nos. 1 through 6 according to the present invention, and test pieces made of sintered alloy as comparative samples and having compositions Nos. 7 and 8, and a test piece made of steel (SCM 440) as a comparative sample and having a composition No. 9. To produce each of the sintered alloys, the powdered material therefor is compacted at the compacting pressure of 4 to 6 t/cm$^2$, and then sintered at a temperature of 1050° to 1200° C. (average temperature was 1120° C.) under an ammonia decomposition gas atmosphere in a furnace for 1 to 2 hours. The steel is produced by the employment of a furnace under the same conditions as the sintering furnace condition.

Wear Test

Surface hardness of each of the test pieces is measured. An Amsler wear test is conducted on each of the pieces. At that time, the test piece is rotated on a constant slip wear testing machine and brought into contact with a stationary plate (opponent member) made of an aluminum alloy. Lubricating oil is continuously supplied to the contact surfaces of two pieces. The testing conditions are as follows:

Outside diameter of the rotated test piece—40 mm
Lubricating oil—10 W—30
Oil temperature—80° C.
Oil quantity—0.5 litters/min
Load on the pieces—100 kgf
Sliding velocity between the pieces—2.5 m/sec
Running period—150 hours As shown in Table 1, the amount of wear of the test pieces of the sintered alloys provided in accordance with the present invention and that of the opponent piece are much less than those of the test pieces used as the comparative samples.

Machining Tip Life Test

Each of the test pieces is shaped in cylindrical shape having 48 mm in diameter and 25 mm in thickness. The test pieces are then cut by a tool tip on a lathe. The life of the tool tip is measured. The cutting conditions are as follows:

Rotational frequency of each test piece—800 rpm
Cutting feed velocity—0.32 rev.
Cut-away quantity—1 mm
Water soluble cutting material was supplied to the test piece and the tool tip.

Table 1 shows the number of times of possible 1 mm cutting of the identical test piece made by a single tool tip. It is understood from Table 1 that service life of the tool tip in cutting the test pieces made of the sintered alloys provided in accordance with the present invention is much longer than that of the tool tip in cutting the test pieces used as the comparative samples.

Figure 1:
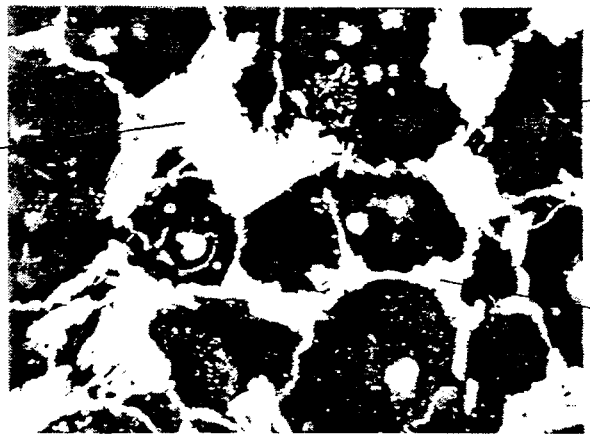
FIG. 1 shows a microscopic photograph of the metal structure of a sintered alloy which is provided in accordance with the present invention and constitutes each assembled portion of an assembled cam shaft except the cam lobe and steel shaft member.

FIG. 1 shows a microscopic photograph (magnified to 200 times) of the structure etched by nital etchant of a sintered alloy for the assembling pieces except for the cam lobe, which has the composition samples No. 1 shown in Table 1. It is understood from FIG. 1 that carbide B (cementite and steadite) which serves to enhance wear resistance of the sintered alloy and free copper C which serves to enhance machinability and wear resistance of the sintered alloys are distributed in the pearlitic matrix A.

Figure 2:
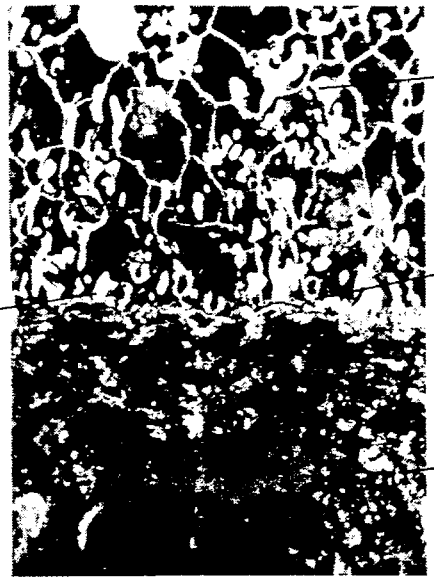
FIG. 2 shows a microscopic photograph of the metal structure of the conjoined regions defined by the steel shaft member and the assembled portion except the cam lobe.

FIG. 2 shows a microscopic photograph (magnified to 100 times) of the structure (etched by nital etchant) of the conjoined region of the sintered alloy D (shown in FIG. 1) on a steel shaft member E. Shown at F in FIG. 2 is a copper-brazed part, and shown at G in FIG. 2 is a diffusion-bonded part based on the liquid-phase sintering.

TABLE 1

| Kind of material | | Composition (% by weight) | | | | | | | | | | Shrinkage (%) | Surface hardness (HRB) | Wear (μm) | | Machining tip life (number of times) |
|---|---|---|---|---|---|---|---|---|---|---|---|---|---|---|---|---|
| | No | C | P | Cu | Mn | Si | Ni | Mo | Cr | B | Fe & impurities | | | Test piece | Reference piece | |
| Material | 1 | 1.6 | 0.6 | 25 | 0.11 | 0.05 | — | — | — | — | balance | 3.9 | 100 | 8 | 5 | 62 |
| accoring | 2 | 0.8 | 0.3 | 25 | 0.20 | 0.02 | — | — | — | — | balance | 0.4 | 86 | 10 | 4 | 70 |
| to the | 3 | 1.6 | 0.6 | 25 | 0.11 | 0.05 | 1.0 | — | — | — | balance | 4.4 | 102 | 8 | 6 | 55 |
| present | 4 | 1.4 | 0.6 | 25 | 0.11 | 0.05 | — | 0.5 | — | — | balance | 5.2 | 107 | 5 | 5 | 55 |
| invention | 5 | 1.4 | 0.6 | 25 | 0.11 | 0.05 | — | — | 1.0 | — | balance | 4.5 | 110 | 5 | 10 | 52 |

TABLE 1-continued

| Kind of material | No | Composition (% by weight) C | P | Cu | Mn | Si | Ni | Mo | Cr | B | Fe & impurities | Shrinkage (%) | Surface hardness (HRB) | Wear (μm) Test piece | Wear (μm) Reference piece | Machining tip life (number of times) |
|---|---|---|---|---|---|---|---|---|---|---|---|---|---|---|---|---|
| | 6 | 1.4 | 0.6 | 25 | 0.11 | 0.05 | — | — | — | 0.05 | balance | 5.0 | 105 | 7 | 6 | 60 |
| Sample | 7 | 2.0 | 0.6 | — | 0.15 | 0.04 | — | — | — | — | balance | 4.1 | 105 | 15 | 13 | 35 |
| material | 8 | 1.8 | 0.5 | — | 0.21 | 0.8 | — | 1.0 | 4.3 | — | balance | 4.5 | HRC41 | 5 | 33 | 9 |
| | 9 | | | | | Steel (SCM 440) | | | | | | | 104 | 30 | 25 | 24 |

According to the present invention, all of the assembled portions of an assembled cam shaft can be conjoined to the steel shaft member by a single sintering, and have high wear resistance. The assembled portions except for the cam lobe and the steel shaft member are made of a sintered alloy which provides high machinability. Therefore, high manufacturing efficiency of the assembled cam shaft can be attained

What is claimed is:

1. An assembled cam shaft member whose assembled portion, except for a cam lobe is made of sintered material, said sintered material consisting essentially of 0.5 to 4.0% by weight of carbon, 0.1 to 80% by weight of phosphorus, 5 to 50% by weight of copper, at least one of 0.11 to 1% by weight of magnasese and 0.02 to 2% by weight of silicon, and the substantial balance being iron and impurities, said copper acting to braze each assembled portion to the shaft member.

2. An assembled cam shaft member whose assembled portion except for a cam lobe is made of a sintered material, said sintered material consisting essentially of 0.5 to 4.0% by weight of carbon, 0.1 to 0.8% by weight of phosphorus, 5 to 50% by weight of copper, at least one of 0.11 to 1% by weight of manganese and 0.2 to 2% by weight of silicon, at least one member selected from the group consisting of 0.5 to 3.0% by weight of nickel, 0.1 to 2.0% by weight of molybdenum, 0.1 to 2.0% by weight of chromium, and 0.01 to 1.0% by weight of boron, and the balance being iron and impurities, said copper acting to braze each assembled portion to the shaft member.

3. An assembled cam shaft as claimed in claim 1, wherein said sintered material contains 15 to 40% by weight of copper.

4. An assembled cam shaft as claimed in claim 2, wherein said sintered material contains 15 to 40% by weight of copper.

* * * * *